US006811467B1

(12) United States Patent
Beresford et al.

(10) Patent No.: US 6,811,467 B1
(45) Date of Patent: Nov. 2, 2004

(54) METHODS AND APPARATUS FOR POLISHING GLASS SUBSTRATES

(75) Inventors: Ian Joseph Beresford, Milpitas, CA (US); Robert Lloyd Babcock, Milpitas, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 10/349,032

(22) Filed: Jan. 23, 2003

Related U.S. Application Data

(60) Provisional application No. 60/409,409, filed on Sep. 9, 2002.

(51) Int. Cl.[7] ..... B24B 7/00

(52) U.S. Cl. ..... 451/28; 451/41; 451/57; 451/285

(58) Field of Search ..... 451/28, 60, 41, 451/57, 59, 63, 65, 285–289; 438/692, 693; 51/308

(56) References Cited

U.S. PATENT DOCUMENTS 5,913,712 A * 6/1999 Molinar ..... 451/41
6,120,354 A * 9/2000 Koos et al. ..... 451/41
6,248,143 B1 6/2001 Masuda et al.
6,287,175 B1 9/2001 Marukawa et al.
6,332,831 B1 12/2001 Shemo et al.
6,371,834 B1 4/2002 Fujimura et al.
6,407,000 B1 * 6/2002 Hudson ..... 438/693
6,428,396 B2 8/2002 Isono et al.
6,447,693 B1 * 9/2002 Pryor ..... 252/79.1
6,458,018 B1 10/2002 Goers et al.
6,461,227 B1 10/2002 Fang
6,468,137 B1 10/2002 Fang et al.
6,491,572 B1 12/2002 Horie et al.
6,500,052 B2 12/2002 Natsuhara et al.
6,500,053 B2 12/2002 James et al.
6,503,600 B2 1/2003 Watanabe et al.

* cited by examiner

*Primary Examiner*—Lee D. Wilson
(74) *Attorney, Agent, or Firm*—McDermott Will & Emery LLP

(57) ABSTRACT

A method of polishing a surface of a glass, ceramic, or glass-ceramic substrate to minimize the waviness, waviness variation, and average surface roughness of the surface, whereby the substrate is usable for a magnetic or magneto-optical (MO) data/information storage retrieval medium, comprising sequential steps of:

(a) performing a primary polishing of the substrate surface in a first polishing apparatus, utilizing a first polishing slurry containing particles of a first abrasive;

(b) transferring the substrate to a second polishing apparatus; and (c) performing a final polishing of the substrate surface in the second polishing apparatus, utilizing a second polishing slurry containing particles of a second abrasive, the particles of the second abrasive being smaller than the particles of the first abrasive.

17 Claims, 5 Drawing Sheets

METHODS AND APPARATUS FOR POLISHING GLASS SUBSTRATES

CROSS-REFERENCE TO PROVISIONAL APPLICATION

This application claims priority from U.S. provisional patent application Ser. No. 60/409,409 filed Sep. 9, 2002, the entire disclosure of which is incorporated herein by reference.

FIELD OF THE INVENTION

The present invention relates to improved methods and apparatus for processing surfaces of glass substrates to provide low roughness and low, uniform waviness over the substrate surface. The invention has particular utility in surface preparation (i.e., polishing) of disk-shaped glass or glass-based substrates for use in the manufacture of magnetic data/information storage and retrieval media, e.g., hard disks.

BACKGROUND OF THE INVENTION

Magnetic recording media are widely used in various applications, particularly in the computer industry. A portion of a conventional recording medium 1 utilized in disk form in computer-related applications is schematically depicted in FIG. 1 and comprises a non-magnetic substrate 10, typically of metal, e.g., an aluminum-magnesium (Al—Mg) alloy, having sequentially deposited thereon a plating layer 11, such as of amorphous nickel-phosphorus (NiP), a polycrystalline underlayer 12, typically of chromium (Cr) or a Cr-based alloy, a magnetic layer 13, e.g., of a cobalt (Co)-based alloy, a protective overcoat layer 14, typically containing carbon (C), e.g., diamond-like carbon ("DLC"), and a lubricant topcoat layer 15, typically of a perfluoropolyether compound applied by dipping, spraying, etc.

In operation of medium 1, the magnetic layer 13 can be locally magnetized by a write transducer or write head, to record and store data/information. The write transducer creates a highly concentrated magnetic field which alternates direction based on the bits of information being stored. When the local magnetic field produced by the write transducer is greater than the coercivity of the recording medium layer 13, then the grains of the polycrystalline medium at that location are magnetized. The grains retain their magnetization after the magnetic field produced by the write transducer is removed. The direction of the magnetization matches the direction of the applied magnetic field. The pattern of magnetization of the recording medium can subsequently produce an electrical response in a read transducer, allowing the stored medium to be read.

Thin film magnetic recording media are conventionally employed in disk form for use with disk drives for storing large amounts of data in magnetizable form. Typically, one or more disks are rotated on a central axis in combination with data transducer heads. In operation, a typical contact start/stop ("CSS") method commences when the head begins to slide against the surface of the disk as the disk begins to rotate. Upon reaching a predetermined high rotational speed, the head floats in air at a predetermined distance from the surface of the disk due to dynamic pressure effects caused by the air flow generated between the sliding surface of the head and the disk. During reading and recording operations, the transducer head is maintained at a controlled distance from the recording surface, supported on a bearing of air as the disk rotates, such that the head can be freely moved in both the circumferential and radial directions, allowing data to be recorded on and retrieved from the disk at a desired position. Upon terminating operation of the disk drive, the rotational speed of the disk decreases and the head again begins to slide against the surface of the disk and eventually stops in contact with and pressing against the disk. Thus, the transducer head contacts the recording surface whenever the disk is stationary, accelerated from the static position, and during deceleration just prior to completely stopping. Each time the head and disk assembly is driven, the sliding surface of the head repeats the cyclic sequence consisting of stopping, sliding against the surface of the disk, floating in air, sliding against the surface of the disk, and stopping.

It is considered desirable during reading and recording operations, and for obtainment of high areal recording densities, to maintain the transducer head as close to the associated recording surface as is possible, i.e., to minimize the "flying height" of the head. Thus, a smooth recording surface is preferred, as well as a smooth opposing surface of the associated transducer head, thereby permitting the head and the disk surface to be positioned in close proximity, with an attendant increase in predictability and consistent behavior of the air bearing supporting the head during motion.

Meanwhile, the continuing trend toward manufacture of very high areal density magnetic recording media at reduced cost provides impetus for the development of lower cost materials, e.g., polymers, glasses, ceramics, and glass-ceramics composites as replacements for the conventional Al alloy-based substrates for magnetic disk media. However, poor mechanical and tribological performance, track mis-registration ("TMR"), and poor flyability have been particularly problematic in the case of polymer-based substrates fabricated as to essentially copy or mimic conventional hard disk design features and criteria. On the other hand, glass, ceramic, or glass-ceramic materials are attractive candidates for use as substrates for very high areal density disk recording media because of the requirements for high performance of the anisotropic thin film media and high modulus of the substrate. However, the extreme difficulties encountered with grinding and lapping of glass, ceramic, and glass-ceramic composite materials have limited their use to only higher cost applications, such as mobile disk drives for "notebook"-type computers.

As employed herein, the term "glass" is taken to include, in the broadest sense, non-crystalline silicates, aluminosilicates, borosilicates, boroaluminosilicates, as well as polycrystalline silicates, aluminosilicates, and oxide materials; the term "ceramic" is taken to include materials consisting of crystalline particles bonded together either with a glass (i.e., vitreous) matrix or via fusion of the particles at their grain boundaries, as by sintering, as well as refractory nitrides, carbides, and borides when prepared in the form of bodies, as by sintering with or without a glass matrix or a silicon- or boron-containing matrix material, e.g., silicon nitride ($Si_3N_4$), silicon carbide (SiC), and boron carbide ($B_4C$); and the term "glass-ceramics" is taken to include those materials which are melted and fabricated as true glasses, and then converted to a partly crystalline state, such materials being mechanically stronger, tougher, and harder than the parent glass, as well as non-porous and finer-grained than conventional polycrystalline materials.

As indicated supra, glass and glass-ceramic materials are attractive candidates for use as substrates for magnetic data/information storage and retrieval media, e.g., hard disks. However, the extreme difficulties encountered with the surface preparation of such materials, e.g., grinding, lapping, polishing, etc., have heretofore limited their use to only higher cost applications, such as mobile disk drives for "notebook"-type computers. Further, existing systems for polishing glass or glass-ceramic materials for use as substrates for magnetic recording media do not provide polishing platforms with adequate capability for current disk drive technology and requirements, particularly with respect to substrate micro-roughness, waviness, and uniformity. In other instances, existing systems for polishing glass or glass-ceramic materials for use as media substrates provided polished surfaces free of imperfections but did not planarize or polish the surfaces to a degree compatible with the increased areal recording densities of current mechanical disk drive systems.

In view of the foregoing, there exists a clear need for improved means and methodology for providing high modulus glass or glass-based substrates for magnetic data/information storage and retrieval media, e.g., disk-shaped substrates, with at least one surface thereof having requisite topography, i.e., low waviness over the entire surface together with lower average roughness, for enabling operation of the media with read/write transducers/heads operating at very low flying heights.

The present invention addresses and solves problems and difficulties attendant upon the surface preparation of very hard, high modulus materials, e.g., glasses, ceramics, and glass-ceramics, for use as substrate materials in the manufacture of very high areal density magnetic recording media, while maintaining full capability with substantially all aspects of conventional automated manufacturing technology for the fabrication of thin-film magnetic media. Further, the methodology and means afforded by the present invention enjoy diverse utility in the manufacture of various other devices and media requiring formation of low waviness, low average surface roughness surfaces on high hardness materials.

DISCLOSURE OF THE INVENTION

An advantage of the present invention is an improved method of polishing at least one surface of a glass, ceramic, or glass-ceramic substrate.

Another advantage of the present invention is an improved method of polishing at least one surface of a glass, ceramic, or glass-ceramic substrate to minimize the waviness, the variation in waviness, and the average surface roughness of said at least one surface, whereby the substrate is usable as a substrate for a magnetic or magneto-optical (MO) data/information storage retrieval medium.

Yet another advantage of the present invention is an improved system for polishing at least one surface of a glass, ceramic, or glass-ceramic substrate.

A further advantage of the present invention is an improved system for polishing at least one surface of a glass, ceramic, or glass-ceramic substrate to minimize the waviness, the variation in waviness, and the average surface roughness of said at least one surface, whereby the substrate is usable as a substrate for a magnetic or magneto-optical (MO) data/information storage retrieval medium.

A still further advantage of the present invention is an improved polishing pad for polishing a surface of a glass, ceramic, or glass-ceramic substrate.

A yet further advantage of the present invention is an improved polishing pad for polishing at least one surface of a glass, ceramic, or glass-ceramic substrate to minimize the waviness, the variation in waviness, and the average surface roughness of said at least one surface, whereby the substrate is usable as a substrate for a magnetic or magneto-optical (MO) data/information storage retrieval medium.

Another advantage of the present invention is an improved method of manufacturing a polishing pad for use in polishing a surface of a glass, ceramic, or glass-ceramic substrate.

A yet further advantage of the present invention is an improved method of manufacturing a polishing pad for polishing at least one surface of a glass, ceramic, or glass-ceramic substrate to minimize the waviness, the variation in waviness, and the average surface roughness of said at least one surface, whereby the substrate is usable as a substrate for a magnetic or magneto-optical (MO) data/information storage retrieval medium.

Additional advantages and other aspects and features of the present invention will be set forth in the description which follows and in part will become apparent to those having ordinary skill in the art upon examination of the following or may be learned from the practice of the present invention. The advantages of the present invention may be realized and obtained as particularly pointed out in the appended claims.

According to an aspect of the present invention, the foregoing and other advantages are obtained in part by a method of polishing at least one surface of a glass, ceramic, or glass-ceramic substrate to minimize the waviness, the variation in waviness, and the average surface roughness of the at least one surface, whereby the substrate is usable as a substrate for a magnetic or magneto-optical (MO) data/information storage retrieval medium, the method comprising sequential steps of:

(a) performing a primary polishing of the at least one surface of the substrate in a first polishing apparatus, utilizing a first polishing slurry containing particles of a first abrasive;

(b) transferring the substrate to a second polishing apparatus; and (c) performing a final polishing of the at least one surface of the substrate in the second polishing apparatus, utilizing a second polishing slurry containing particles of a second abrasive, the particles of the second abrasive being smaller than the particles of the first abrasive.

According to embodiments of the present invention, steps (a) and (c) comprise utilizing first and second polishing apparatuses comprising respective first and second polishing pads each having a polishing surface treated to harden it and to minimize absorption of the particles of the first and second abrasives, i.e., steps (a) and (c) comprise utilizing first and second polishing apparatuses comprising respective first and second porous polishing pads including a ceramic or an amorphous glass material deposited on the polishing surface to harden it and to reduce the void area thereof without creating a hydrophobic condition.

Preferred embodiments of the present invention include those wherein steps (a) and (c) comprise utilizing first and second polishing apparatuses comprising respective first and second high density, formable polishing pads made of a polyurethane or woven material and the amorphous glass material deposited on the polishing surfaces is derived from at least one metal silicate.

According to preferred embodiments of the present invention useful in polishing substrate surfaces for use in manufacture of thin film magnetic and/or magneto-optical recording media, step (a) comprises removing up to about 50 $\mu$m of glass, ceramic, or glass-ceramic material from the surface of the substrate to form a planar and uniform surface having an average roughness Ra of about 4 Å and a waviness of about 4 Å; and step (c) comprises removing less than about 3 $\mu$m of glass, ceramic, or glass-ceramic material from the surface of the substrate to form a planar and uniform surface having an average roughness Ra of about 1 Å and a waviness of about 2 Å over the entire surface; wherein step (a) comprises utilizing a $CeO_2$-based abrasive slurry as the first polishing slurry; and step (c) comprises utilizing a colloidal $SiO_2$-based abrasive slurry as the second polishing slurry.

In accordance with these preferred embodiments, step (a) comprises utilizing a $CeO_2$-based first polishing slurry comprising $CeO_2$ particles having sizes <0.2 $\mu$m; and step (c) comprises utilizing a colloidal $SiO_2$-based second polishing slurry comprising $SiO_2$ particles having sizes <25 nm; wherein step (a) comprises utilizing a $CeO_2$-based first polishing slurry wherein the size distribution of the $CeO_2$ particles is <+/−3 $D_{50}$, $D_{50}$ being the mean particle size at the centerline of the $CeO_2$ particle size distribution, and wherein step (a) comprises utilizing a $CeO_2$-based first polishing slurry comprising about 3.0 to about 5.0% by volume $CeO_2$ solids; and step (c) comprises utilizing a colloidal $SiO_2$-based second polishing slurry comprising about 9.0 to about 11.5% by volume colloidal $SiO_2$ solids.

According to embodiments of the present invention, step (a) comprises utilizing a first polishing apparatus comprising means for recirculating the first polishing slurry, the recirculating means including filter means for removing particles of sizes equal to or greater than a pre-selected size from the first polishing slurry; step (c) comprises utilizing a second polishing apparatus comprising means for recirculating the second polishing slurry, the recirculating means including filter means for removing particles of sizes equal to or greater than a pre-selected size from the second polishing slurry; and step (b) comprises transferring the substrate in a wet state from the first polishing apparatus to the second polishing apparatus.

Another aspect of the present invention is a system for polishing at least one surface of a glass, ceramic, or glass-ceramic substrate to minimize the waviness, the variation in waviness, and the average surface roughness of the at least one surface, whereby the substrate is usable as a substrate for a magnetic or magneto-optical (MO) data/information storage retrieval medium, the system comprising:

(a) a first polishing apparatus for performing a primary polishing of the at least one surface of the substrate, comprising a first polishing slurry containing particles of a first abrasive;

(b) means for transferring the substrate from said first polishing apparatus to a second polishing apparatus; and (c) a second polishing apparatus for performing a final polishing of the at least one surface of said substrate, comprising a second polishing slurry containing particles of a second abrasive, the particles of the second abrasive being smaller than the particles of the first abrasive.

According to embodiments of the present invention, each of the first polishing apparatus (a) and the second polishing apparatus (c) is a planetary polishing apparatus comprising a porous polishing pad having a polishing surface treated to harden it and to minimize absorption of the particles of the first and second abrasives.

Preferred embodiments of the present invention include those wherein each of the first polishing apparatus (a) and the second polishing apparatus (c) comprises a porous polishing pad including a ceramic or amorphous glass material deposited on the polishing surface to harden it and to reduce the void area thereof without creating a hydrophobic condition; wherein each of the first polishing apparatus (a) and the second polishing apparatus (c) comprises a high density, formable polishing pad made of a polyurethane or woven material and the amorphous glass material deposited on the polishing surfaces is derived from a metal silicate.

According to preferred embodiments of the present invention, each of the first polishing apparatus (a) and the second polishing apparatus (c) comprises means for recirculating the respective polishing slurry, each recirculating means including filter means for removing particles of sizes equal to or greater than a pre-selected size from the respective polishing slurry; and the means for transferring said substrate from the first polishing apparatus to the second polishing apparatus comprises means for transferring the substrate in a wet state.

Yet another aspect of the present invention is a polishing pad for use in polishing a surface of a glass, ceramic, or glass-ceramic substrate to minimize the waviness, the variation in waviness, and the average surface roughness of the at least one surface, whereby the substrate is usable as a substrate for a magnetic or magneto-optical (MO) data/information storage retrieval medium, comprising:

a porous polishing pad having a polishing surface treated to harden it and to minimize absorption of abrasive particles of less than a pre-selected size.

According to preferred embodiments of the present invention, the porous polishing pad comprises a ceramic or amorphous glass material deposited on the polishing surface to harden it and to reduce the void area thereof without creating a hydrophobic condition; wherein the polishing pad comprises a high density, formable polyurethane or woven material and said amorphous glass material deposited on said polishing surface is derived from at least one metal silicate.

Still another aspect of the present invention is a method of manufacturing a polishing pad for use in polishing a surface of a glass, ceramic, or glass-ceramic substrate to minimize the waviness, the variation in waviness, and the average surface roughness of the at least one surface, whereby the substrate is usable as a substrate for a magnetic or magneto-optical (MO) data/information storage retrieval medium, comprising sequential steps of:

(a) providing a pad of a high density, formable, porous material;

(b) placing the pad on a platen, the pad having an exposed upper surface;

(c) shaping/dressing the pad to eliminate imperfections on the exposed upper surface of the pad arising from the underlying platen; and (d) forming a layer of a ceramic or amorphous glass material on the pad which coats and fills pores in the exposed upper surface.

According to embodiments of the present invention, step (d) comprises sequential sub-steps of:

($d_1$) saturating the pad with a liquid containing at least one amorphous glass material applied to the exposed upper surface of the pad;

($d_2$) drying the liquid to form a layer of the amorphous glass material at least partially filling the pores and coating the exposed upper surface; and ($d_3$) curing the layer of amorphous glass material at an elevated temperature.

Preferred embodiments of the present invention include those wherein step (a) comprises providing a pad composed of a porous polyurethane or a woven material; step ($d_1$)

comprises applying an aqueous liquid containing at least one metal silicate to the exposed upper surface of the pad; and step ($d_3$) comprises planarizing/polishing the exposed upper surface of the pad at an applied pressure, rpm, and interval selected to compress the pad and generate sufficient frictional heat to effect curing of the layer of amorphous glass material at an elevated temperature; wherein step ($d_1$) comprises spraying an aqueous liquid containing hydrated aluminum silicate and lithium silicate on the exposed upper surface of said pad; and step ($d_3$) comprises planarizing/polishing the exposed upper surface of the pad utilizing a ceramic plate and a $CeO_2$-based abrasive polishing slurry containing a caustic reducing agent.

A further aspect of the present invention is a polishing pad made according to the above process.

Additional advantages and aspects of the present invention will become readily apparent to those skilled in the art from the following detailed description, wherein embodiments of the present invention are shoen and described, simply by way of illustration of the best mode contemplated for practicing the present invention. As will be described, the present invention is capable of other and different embodiments, and its several details are susceptible of modification in various obvious respects. Accordingly, the drawings and description are to be regarded as illustrative in nature, and not as limitative.

BRIEF DESCRIPTION OF THE DRAWINGS

The following detailed description of the embodiments of the present invention can best be understood when read in conjunction with the following drawings, in which the features are not necessarily drawn to scale but rather are drawn as to best illustrate the pertinent features, wherein.

DESCRIPTION OF THE INVENTION

Figure 1:
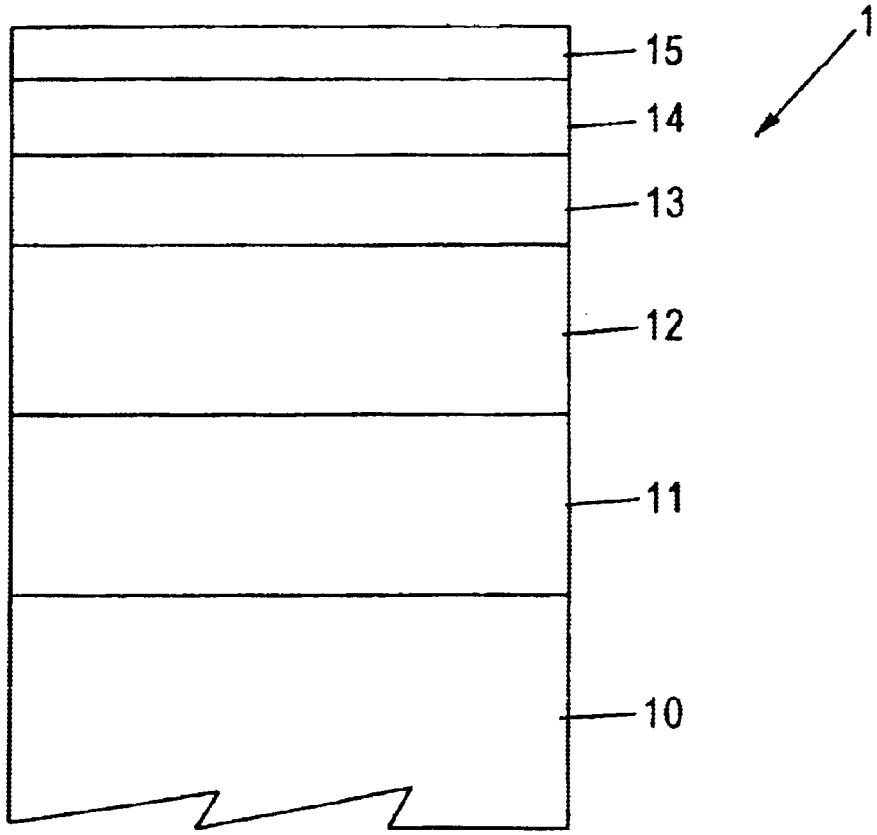
FIG. 1 illustrates, in schematic, simplified cross-sectional view, a portion of a thin film magnetic data/information storage and retrieval medium.

The present invention addresses and solves problems attendant upon the surface preparation, i.e., polishing, of very hard-surfaced, high modulus materials, e.g., of glass, ceramics, and glass-ceramics, for use as substrates in the manufacture of thin film, high areal density magnetic and/or magneto-optical (MO) recording media, and is based upon the discovery by the present inventors that the surfaces of the aforementioned substrate materials can be successfully polished to yield substrates suitable for use in such applications, i.e., with minimum waviness, minimum waviness variation over the substrate surface, and very low average surface roughness (Ra).

The present invention is based upon the discovery by the present inventors that several key inventive features or aspects, utilized in concert, are necessary for facilitating polishing of the aforementioned hard-surfaced, high modulus materials to yield polished surfaces consistent with requirements for their use in the manufacture of high areal density recording media. Specifically, key features or aspects of the inventive methodology include:

(1) use of first and second planetary polishing apparatus, wherein a first, or preliminary, polish of the substrate surface is performed utilizing an optimized abrasive slurry comprising a pre-selected % solids content of abrasive particles with a particular particle size distribution, whereby a relatively larger amount of material is removed from the surface of the substrate; and wherein a second, or final, polish of the substrate is performed utilizing another optimized abrasive slurry comprising a pre-selected % solids content of colloidal abrasive particles, whereby a relatively small amount of material is removed from the surface of the substrate;

(2) use of first and second planetary polishing systems each equipped with means for recirculating and filtering the abrasive slurry to remove abrasive particles, polishing debris, etc., having sizes exceeding a pre-selected maximum size;

(3) use of polishing pads which have been pre-treated to decrease their void area or porosity, hence absorption of abrasive particles, and to increase their surface hardness without creating hydrophobic conditions;

(4) ability to control the amount of waviness reduction afforded by the treated pads for a fixed polishing slurry; and (5) use of optimized polish settings/parameters during each of the first and second polishing phases.

The above combination of inventive features and aspects provides a polishing system and methodology which differs from prior systems and methodologies in addressing and meeting the requirements for current disk drive technology, including, inter alia, requirements for micro-roughness, waviness, and uniformity of polished surfaces of hard-surfaced, high modulus glass, ceramic, or glass-ceramic substrate materials for manufacture of high areal density thin film recording media. Specifically, the inventive means and methodology differs from prior polishing systems and methodologies in allowing the use of smaller particle size abrasive slurries at steady state conditions, thereby providing desirable surface topographies without sacrifice in the ability to remove glass, ceramic, or glass-ceramic material and surface imperfections at high rates during the polishing process. Accordingly, the inventive means and methodology affords obtainment of lower surface waviness, consistently low surface waviness over the entire surface, and lower average roughness (Ra).

Figure 2:
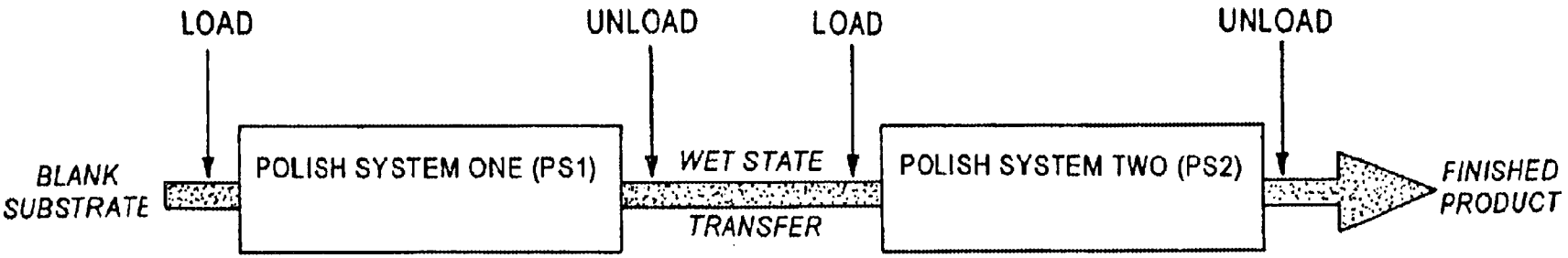
FIG. 2 illustrates, in schematic, simplified view, a process flowchart for polishing glass, ceramic, or glass-ceramic substrates according to the inventive methodology.

Referring to FIG. 2, shown therein, in schematic, simplified view, is a process flowchart for polishing of glass, ceramic, or glass-ceramic substrates according to the invention, wherein substantially similar first and second planetary polishing systems (such as manufactured by Speedfam-IPEC, now Novellus Systems, Inc., San Jose, Calif.) are serially arranged for performing a first, preliminary polishing and a second, final polishing of glass, ceramic, or glass-ceramic substrate materials. As illustrated, a blank substrate is loaded into the left (inlet) side of a first polishing system (PS 1) equipped with a treated (i.e., hardened) polyurethane or woven polishing pad and supplied with a $CeO_2$-based abrasive polishing slurry and a 10 $\mu$m (nominal) polypropylene filter located in a slurry recirculation loop. Preliminarily polished substrates exiting the first polishing system are unloaded at the right (outlet) side of the first polishing system and transferred in a wet state to be loaded into the left (inlet) side of a second polishing system (PS 2) similarly equipped with a treated (i.e., hardened) polyurethane or woven polishing pad and supplied with a colloidal $SiO_2$-based abrasive polishing slurry and a 5 $\mu$m (nominal) polypropylene filter located in a slurry recirculation loop. Finally polished substrates exiting the second polishing system are unloaded at the right (outlet) side of the second polishing system. Each of the first polishing system inlet, first polishing system outlet, and second polishing system outlet is provided with inspection and/or process control/audit means and each of the first and second polishing systems is provided with means for independently setting and controlling a number of polishing process parameters (described in more detail below).

By way of illustration, but not limitation, according to an embodiment of the invention especially useful in polishing substrate surfaces for use in manufacture of thin film magnetic and/or magneto-optical recording media, up to about 50 $\mu$m of glass, ceramic, or glass-ceramic material is removed from the surface of the substrate in the first polishing system (PS 1) to form a planar and uniform surface having an average roughness Ra of about 4 Å and a waviness of about 4 Å; and less than about 3 $\mu$m of glass, ceramic, or glass-ceramic material is removed from the surface of the substrate in the second polishing system (PS 2) to form a planar and uniform surface having an average roughness Ra of about 1 Å and a waviness of about 2 Å over the entire surface. According to this embodiment of the invention, the first, or preliminary, polishing performed in PS 1 utilizes a $CeO_2$-based first polishing slurry comprising $CeO_2$ particles having sizes <0.2 $\mu$m; and the second, or final, polishing performed in PS 2 utilizes a colloidal $SiO_2$-based second polishing slurry comprising $SiO_2$ particles having sizes <25 nm; wherein the size distribution of the $CeO_2$ particles of the first polishing slurry is $<+/-3\ D_{50}$, $D_{50}$ being the mean particle size at the centerline of the $CeO_2$ particle size distribution, the $CeO_2$-based first polishing slurry comprises about 3.0 to about 5.0% by volume $CeO_2$ solids; and the colloidal $SiO_2$-based second polishing slurry comprises about 9.0 to about 11.5% by volume colloidal $SiO_2$ solids.

Figure 3:
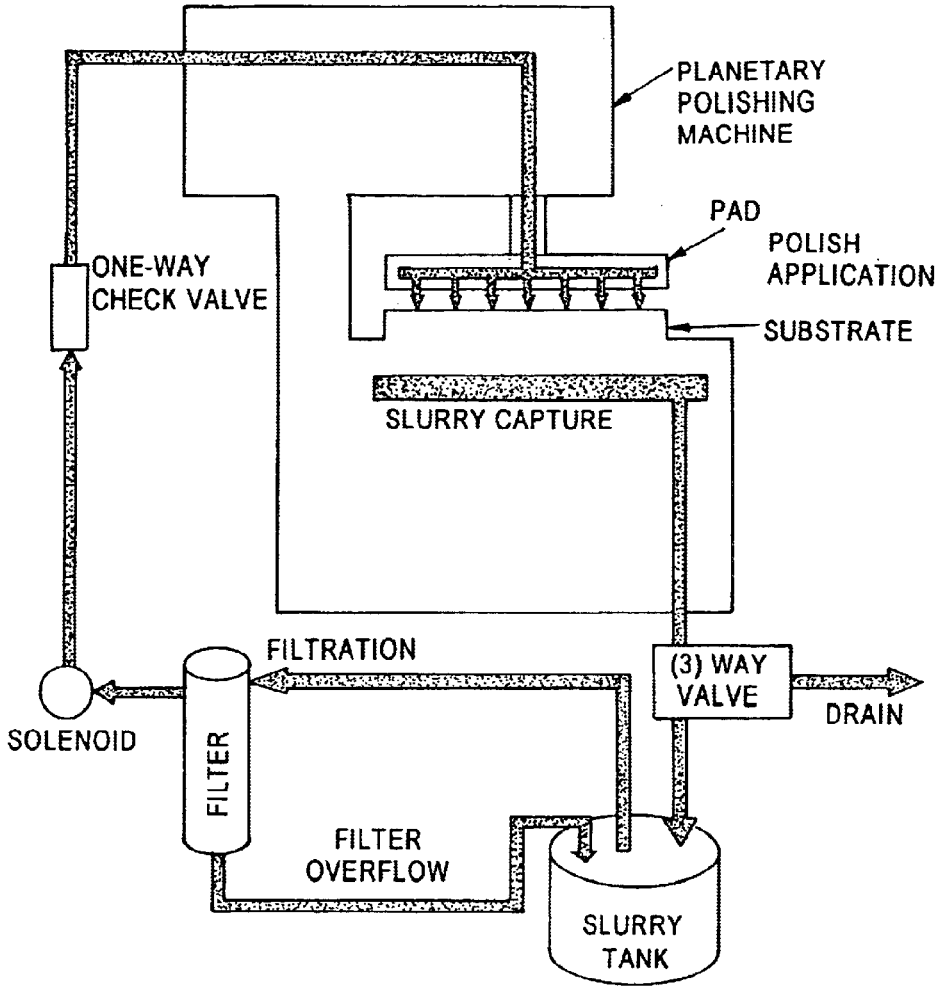
FIG. 3 illustrates, in schematic, simplified cross-sectional view, a system diagram for each of the processing systems PS 1 and PS 2 of FIG. 2.

Adverting to FIG. 3, illustrated therein, in schematic, simplified cross-sectional view, is a diagram of each of the processing systems PS 1 and PS 2 of FIG. 2. As shown therein, abrasive slurry contained in a slurry tank or reservoir is supplied, via a conduit, to a filter for removing therefrom abrasive particles, polishing debris, etc., of sizes greater than a pre-selected maximum size determined by the particular filter element, and supplied by a further conduit, solenoid valve, and one-way check valve (all of conventional type) to a planetary polishing machine, e.g., a Speedfam machine manufactured by Speedfam-IPEC, now Novellus Systems, Inc., San Jose, Calif., wherein the slurry is supplied to a porous or woven polishing pad via a distribution manifold for application to the surface of a substrate being polished. Captured slurry from the polishing process is supplied, via a conduit equipped with a 3-way valve, back to the slurry tank or reservoir for re-use, or to a drain. In addition, the filter is provided with a conduit for returning overflow slurry to the slurry tank or reservoir.

According to the invention, the use of small particle abrasive slurries with narrow particle size distribution mandates tight filtration of the recirculated slurries. Since slurries with large particle sizes and a broad particle size distribution are detrimental for obtaining the desired enhanced topographies, contamination of the slurries from outside sources of any kind will result in scratching (higher roughness) and higher waviness. Therefore, filtration of the $CeO_2$-based slurries to remove particles with sizes equal to or greater than about 10 $\mu$m and filtration of the colloidal $SiO_2$-based slurries to remove particles with sizes equal to or greater than about 5 $\mu$m is considered vital for obtaining the desired topography.

As indicated above, a key feature of the present invention is the use of polishing pads which have been treated to decrease the void area (hence slurry absorption) and increase the hardness thereof without incurring a hydrophobic condition. In this regard, the inventors have identified the polishing surface of the pad as a major obstacle in glass polishing for obtaining the requisite topography enhancements. For example, when $CeO_2$-based abrasive slurries with particle sizes <0.2 $\mu$m and colloidal $SiO_2$-based abrasive slurries with particle sizes <25 nm are utilized with conventional porous or woven polishing pads, significant amounts of the slurries are absorbed into the pores or woven material. According to the invention, therefore, a solution to the absorption problem is to deposit a ceramic or amorphous glass material on the surface of a high density, porous polyurethane or woven polishing pad to reduce the void area at the substrate surface/polishing pad interface without creating a hydrophobic condition. As a consequence, the abrasive slurry particles are uniformly supported between the surface of the polishing pad and the rigid substrate surface, whereby the polishing process can occur to provide an advanced low roughness, low waviness topography while utilizing a material removal process for eliminating surface imperfections. Such surface preparation of the polishing pad is required only when a new pad is installed, prior to polishing.

An illustrative, but not limitative, process for surface preparation of a polishing pad according to the invention proceeds as follows. A virgin high density (i.e., hardness>70 Shore) porous polyurethane or woven polishing pad (e.g., Rodel MH-N15A; Rodel Nitta MH-C14B; or Rodel Suba 1200 (woven), available from Rodel, Inc., Newark, Del., or Rhodes ESM:LP57 or Rhodes ESM:LPM66, available from Universal Photonics, Hicksville, N.Y.) is installed on a platen and subjected to dressing by a diamond dressing ring to remove any surface imperfections such as high and/or low points caused by irregularities in the surface of the underlying platen which project upwardly to the surface of the polishing pad. A solution of an amorphous glass material is then prepared comprising about 10 vol. % hydrated aluminum silicate and about 2 vol. % lithium silicate ($Li_2Si_2O_5$) in de-ionized $H_2O$, which solution is then applied to the surface of the polishing pad, as by spraying. The polishing pad is saturated with the solution and allowed to dry. After drying is complete, the polishing pad is run in a planetary polishing machine with a ceramic polishing plate (e.g., YPEX-5, available from MYG Disk Corp., Japan) at a high pressure and RPM with a $CeO_2$-based abrasive slurry as a lubricant, to which an alkaline (i.e., caustic) reducing agent, e.g., NaOH or KOH, is added to activate the ceramic surface. Heat generated by the friction between the polishing pad and the ceramic plate and the chemical reactions of the curing process produces temperatures above about 120° F. After a specified interval of polishing/curing under high pressure and RPM at elevated temperatures, typically about 120 min., the polishing pad is allowed to dry for at least about an hour to complete the treatment process wherein material is deposited in the pores and at the surface. A final step, after completion of the curing process, is an optional 60-sec. run of the dressing ring or tool at a low pressure and RPM to remove any excess surface material, after which the treated pad may be used with $CeO_2$ or colloidal $SiO_2$ abrasive slurries for polishing glass, ceramic, or glass-ceramic substrates according to the inventive methodology.

Figure 4:
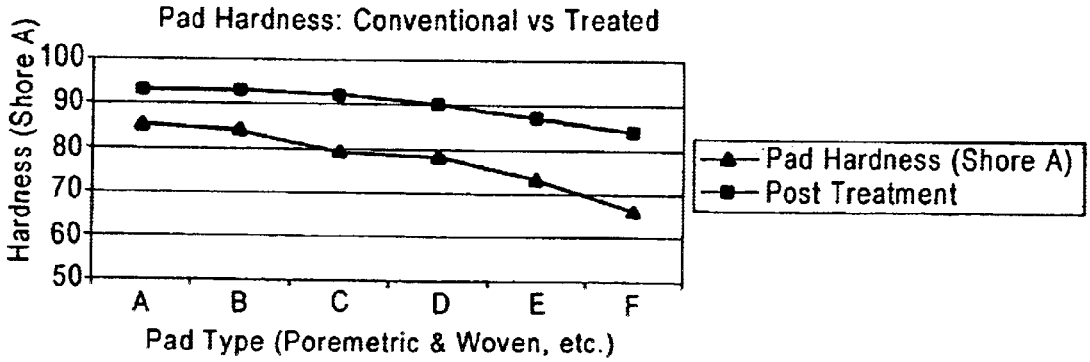
FIG. 4 is a graph for illustrating the increase in polishing pad hardness resulting from treatment according to an aspect of the inventive methodology.

FIG. 4 is a graph illustrating the increase in polishing pad hardness (in Shore A) of a variety of porous and woven polishing pads resulting from treatment such as described above according to an aspect of the inventive methodology, wherein it is evident that the inventive methodology is broadly applicable to a number of different types of polishing pads.

Another key feature of the present invention is related to the above-described modification of the surface of the polishing pad. Specifically, the changes made to the conventional properties of the polishing pad necessitate usage of specifically tailored abrasive slurries. Since the modified polishing pads have decreased porosity resulting in reduced slurry absorption capacity, the distribution of particle sizes around the mean size and the percent abrasive particle solids in the slurry must now be controlled. For example, if the slurry has too broad a particle distribution, i.e., larger than a range of +/−3 $D_{50}$ (where $D_{50}$ is the mean particle size at the centerline of the particle distribution curve), then the larger size abrasive particles trapped between the treated (i.e., coated) polishing pad and the substrate surface will produce an unacceptable roughness, waviness, and a large number of surface scratches. Similarly, if the percent abrasive solids is too high, increased roughness and waviness is observed. Finally, if the percent abrasive solids is too low, detrimental effects on topography are observed due to lack or insufficient amount of polishing abrasive. As a consequence, according to the invention, it is important to use a high purity grade, small particle size $CeO_2$-based abrasive slurry with a narrow particle size distribution and a high quality colloidal $SiO_2$-based abrasive slurry, both of which integrate well with the treated polishing pads according to the present invention to provide the best surface topographies.

Figure 5:
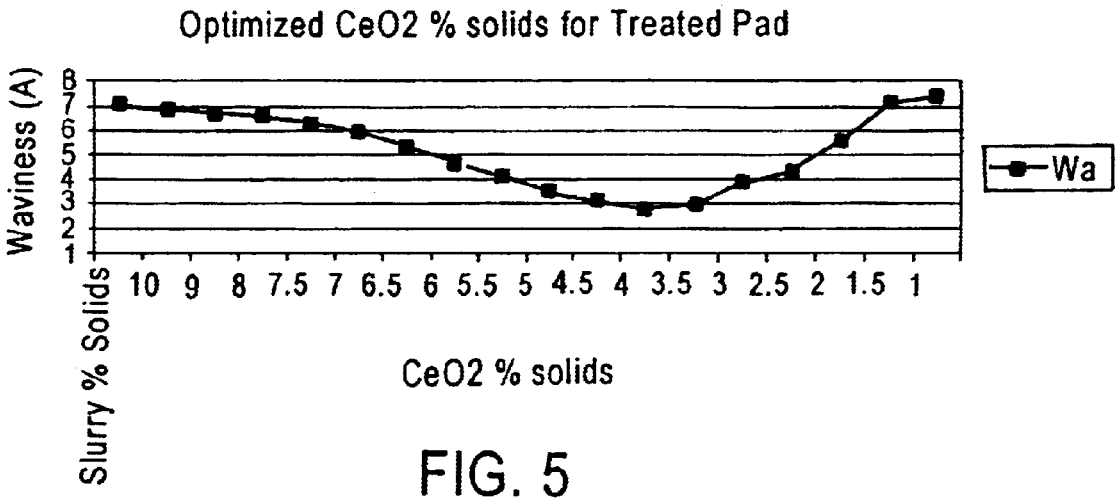
FIG. 5 is a graph for illustrating the effect of variation of the amount of $CeO_2$ solids in the polishing slurry utilized in the first (primary) polishing stage on the measured waviness of the polished samples.
Figure 6:
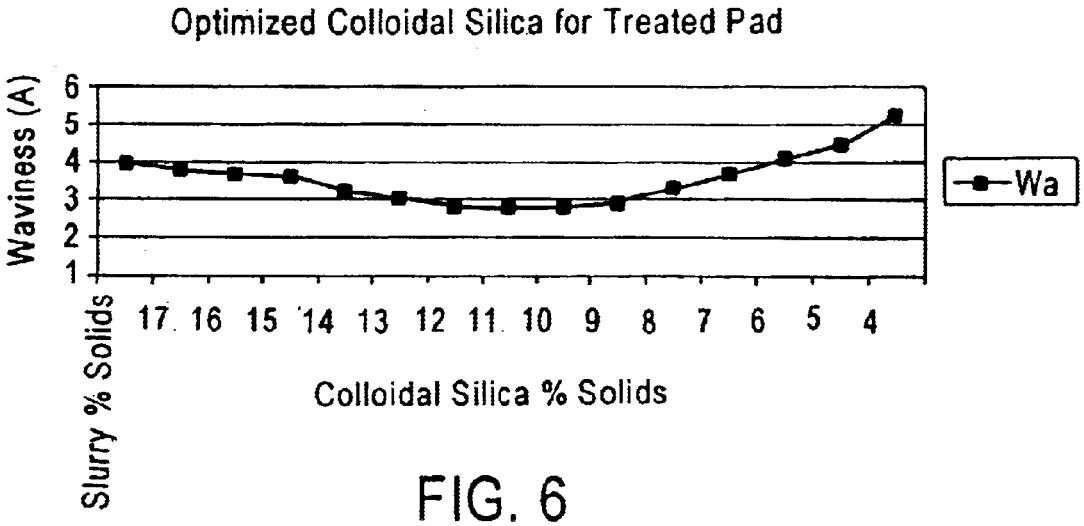
FIG. 6 is a graph for illustrating the effect of variation of the amount of colloidal $SiO_2$ solids in the polishing slurry utilized in the second (final) polishing stage on the measured waviness of the polished samples.

By way of illustration, and not limitation, optimal concentrations of percent $CeO_2$ and $SiO_2$ solids for use with treated pads prepared as described above have been experimentally determined. For example, FIG. 5, which is a graph illustrating the effect of variation of the amount of $CeO_2$ solids in the polishing slurry utilized in the first (primary) polishing stage on the measured waviness of the polished samples, indicates that minimum waviness is achieved when the percent $CeO_2$ solids in the abrasive slurry is in the range from about 3.0 to about 5.0% by volume; and FIG. 6, which is a graph illustrating the effect of variation of the amount of colloidal $SiO_2$ solids in the polishing slurry utilized in the second (final) polishing stage on the measured waviness of the polished samples, indicates that minimum waviness is achieved when the percent colloidal $SiO_2$ solids in the abrasive slurry is in the range from about 9.0 to about 11.5% by volume.

Also, by way of illustration, but not limitation, the following optimized polish settings have been determined to provide the best glass topography with respect to surface roughness (in Å), surface micro-waviness (in Å), and uniformity of surface micro-waviness across the data zone of disk substrates for recording media.

| POLISHING SET CONDITIONS | POLISHING SYSTEM 1 (PS 1) | POLISHING SYSTEM 2 (PS 2) |
|---|---|---|
| Polish Pressure (lbs.) | 400 | 370 |
| Upper Platen (RPM) | 37 | 37 |
| Lower Platen (RPM) | 26 | 34 |
| Pin Ring (RPM) | 10 | 10 |
| Polishing Phases | 2 | 5 |
| Time/Phase (sec.) | 900 +/− 99 | 240 |

Figure 7:
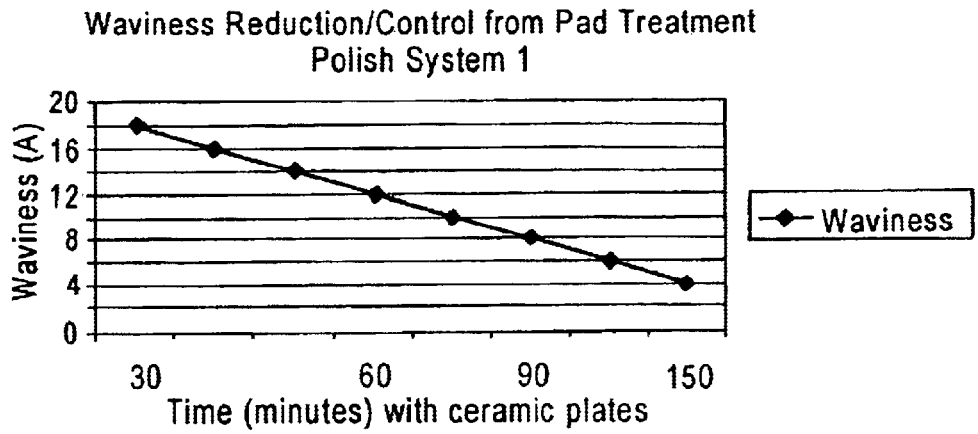
FIG. 7 is a graph for illustrating the variation of the surface waviness observed in Polish System 1 as a function of the treatment time of the polishing pads with ceramic plates.
Figure 8:
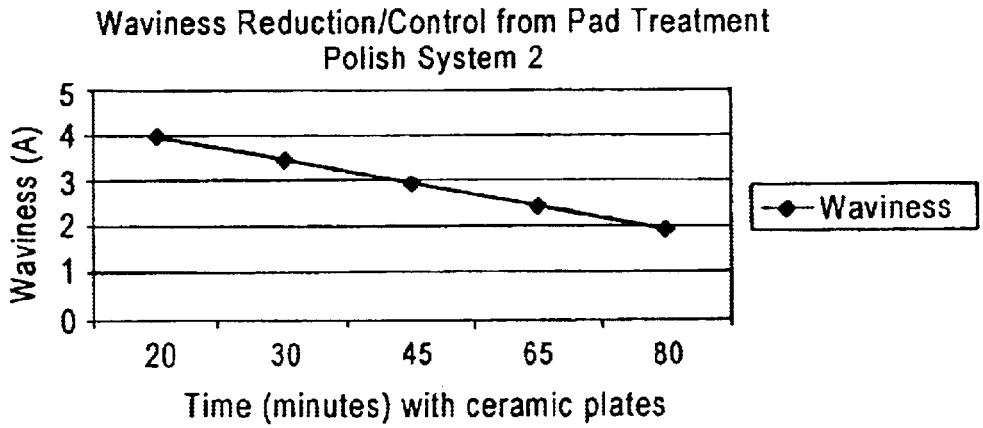
FIG. 8 is a graph for illustrating the variation of the surface waviness observed in Polish System 2 as a function of the treatment time of the polishing pads with ceramic plates.

Yet another advantageous feature of the present invention is the ability to control the pad output, e.g., as determined by the decrease in waviness as a function of the interval of pad treatment with ceramic plates performed as part of the preparation process thereof, while maintaining the slurry parameters constant. Referring to FIG. 7, shown therein is a graph illustrating the variation of the surface waviness observed in Polish System 1, as a function of the treatment time of the polishing pads with ceramic plates. For example, it is evident from FIG. 7 that if the polishing pads are subjected to treatment with the ceramic plates for about 90 min., polished workpieces (substrates) will exhibit a waviness of ~8 Å after each polish cycle ($CeO_2$ slurry-based), whereas shorter treatment of the polishing pads with the ceramic plates, e.g., for about 60 min., will result in the polished workpieces exhibiting a waviness of ~12 Å, and longer treatment of the polishing pads with the ceramic plates, e.g., for about 150 min., will result in the polished workpieces exhibiting a waviness of only ~4 Å. Adverting to FIG. 8, which is a graph illustrating the variation of the surface waviness observed in Polish System 2 as a function of the treatment time of the polishing pads with ceramic plates, a similar situation is observed with the colloidal $SiO_2$-based polishing process performed in Polish System 2, i.e., waviness decreases with increase of the treatment interval of the polishing pads with ceramic plates.

Figure 9:
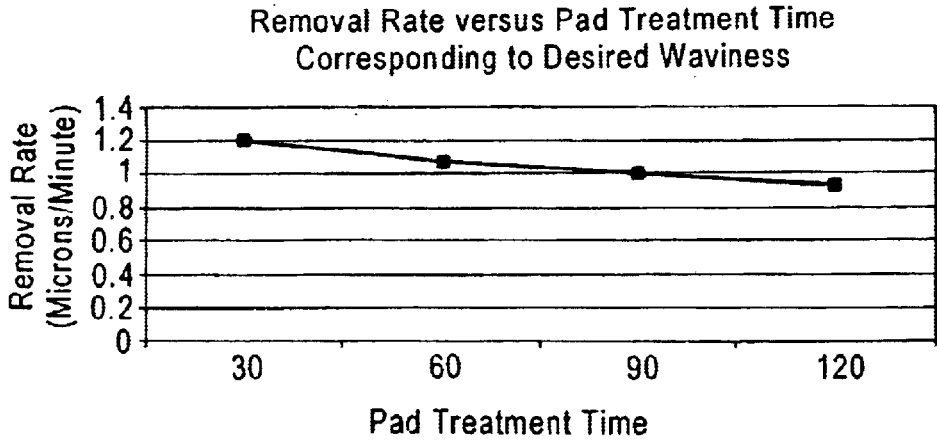
FIG. 9 is a graph for illustrating the variation of the removal rate as a function of the treatment time of the polishing pads with ceramic plates, for a desired waviness.

Referring to FIG. 9, shown therein is a graph illustrating the variation of the removal rate as a function of the treatment time of the polishing pads with ceramic plates, for a desired waviness, wherefrom it is evident that although some rate of removal is lost, it does not decrease proportionally with waviness reduction, and maintains at ~1.0 $\mu$m/min.

Thus, the present invention advantageously provides, as by processing techniques which can be reliably practiced at low cost, improved methodologies and instrumentalities for polishing surfaces of hard-surfaced, high modulus materials, e.g., glass, ceramic, and glass-ceramic materials, to yield substrates with polished surfaces of sufficiently high quality surface topographies and controlled surface waviness facilitating their use as substrates for high areal density thin film magnetic and/or MO recording media. In addition, the present invention provides improved means and methodology for high quality surface polishing of a variety of hard-surfaced, high modulus materials amenable to polishing with planetary polishing apparatus, which materials may be utilized in the manufacture of a variety of products and devices, such as, for example, semiconductor wafers, optical mirrors and lenses.

In the previous description, numerous specific details are set forth, such as specific materials, structures, reactants, processes, etc., in order to provide a better understanding of the present invention. However, the present invention can be practiced without resorting to the details specifically set forth. In other instances, well-known processing materials and techniques have not been described in detail in order not to unnecessarily obscure the present invention.

Only the preferred embodiments of the present invention and but a few examples of its versatility are shown and described in the present disclosure. It is to be understood that the present invention is capable of use in various other combinations and environments and is susceptible of changes and/or modifications within the scope of the inventive concept as expressed herein.

What is claimed is:

1. A method of polishing at least one surface of a glass, ceramic, or glass-ceramic substrate to minimize the waviness, the variation in waviness, and the average surface roughness of said at least one surface, whereby said substrate is usable as a substrate for a magnetic or magneto-optical (MO) data/information storage retrieval medium, said method comprising sequential steps of (a) performing a primary polishing of said at least one surface of said substrate in a first polishing apparatus, utilizing a first polishing slurry containing particles of a first abrasive;

(b) transferring said substrate to a second polishing apparatus; and (c) performing a final polishing of said at least one surface of said substrate in said second polishing apparatus, utilizing a second polishing slurry containing particles of a second abrasive, said particles of said second abrasive being smaller than said particles of said first abrasive.

2. The method as in claim 1, wherein:

steps (a) and (c) comprise utilizing first and second polishing apparatuses comprising respective first and second polishing pads each having a polishing surface treated to harden it and to minimize absorption of said particles of said first and second abrasives.

3. The method as in claim 2, wherein:

steps (a) and (c) comprise utilizing first and second polishing apparatuses comprising respective first and second porous polishing pads including a ceramic or an amorphous glass material deposited on the polishing surface to harden it and to reduce the void area thereof without creating a hydrophobic condition.

4. The method as in claim 3, wherein:

steps (a) and (c) comprise utilizing first and second polishing apparatuses comprising respective first and second high density, formable polishing pads made of a polyurethane or woven material and said amorphous glass material deposited on said polishing surfaces is derived from at least one metal silicate.

5. The method as in claim 2, wherein:

step (a) comprises removing up to about 50 $\mu$m of glass, ceramic, or glass-ceramic material from said surface of said substrate to form a planar and uniform surface having an average roughness Ra of about 4 Å and a waviness of about 4 Å; and step (c) comprises removing less than about 3 $\mu$m of glass, ceramic, or glass-ceramic material from said surface of said substrate to form a planar and uniform surface having an average roughness Ra of about 1 Å and a waviness of about 2 Å over the entire surface.

6. The method as in claim 5, wherein:

step (a) comprises utilizing a $CeO_2$-based abrasive slurry as said first polishing slurry; and step (c) comprises utilizing a colloidal $SiO_2$-based abrasive slurry as said second polishing slurry.

7. The method as in claim 6, wherein:

step (a) comprises utilizing a $CeO_2$-based first polishing slurry comprising $CeO_2$ particles having sizes <0.2 $\mu$m; and step (c) comprises utilizing a colloidal $SiO_2$-based second polishing slurry comprising $SiO_2$ particles having sizes <25 nm.

8. The method as in claim 7, wherein:

step (a) comprises utilizing a $CeO_2$-based first polishing slurry wherein the size distribution of said $CeO_2$ particles is $<+/-3\ D_{50}$, where $D_{50}$ is the mean particle size at the centerline of the $CeO_2$ particle size distribution.

9. The method as in claim 7, wherein:

step (a) comprises utilizing a $CeO_2$-based first polishing slurry comprising about 3.0 to about 5.0% by volume $CeO_2$ solids; and step (c) comprises utilizing a colloidal $SiO_2$-based second polishing slurry comprising about 9.0 to about 11.5% by volume colloidal $SiO_2$ solids.

10. The method as in claim 1, wherein:

step (a) comprises utilizing a first polishing apparatus comprising means for recirculating said first polishing slurry, said recirculating means including filter means for removing particles of sizes equal to or greater than a pre-selected size from said first polishing slurry; and step (c) comprises utilizing a second polishing apparatus comprising means for recirculating said second polishing slurry, said recirculating means including filter means for removing particles of sizes equal to or greater than a pre-selected size from said second polishing slurry.

11. The method as in claim 1, wherein:

step (b) comprises transferring said substrate in a wet state from said first polishing apparatus to said second polishing apparatus.

12. A system for polishing at least one surface of a glass, ceramic, or glass-ceramic substrate to minimize the waviness, the variation in waviness, and the average surface roughness of said at least one surface, whereby said substrate is usable as a substrate for a magnetic or magneto-optical (MO) data/information storage retrieval medium, said system comprising:

(a) a first polishing apparatus for performing a primary polishing of said at least one surface of said substrate, comprising a first polishing slurry containing particles of a first abrasive;

(b) means for transferring said substrate from said first polishing apparatus to a second polishing apparatus; and (c) a second polishing apparatus for performing a final polishing of said at least one surface of said substrate, comprising a second polishing slurry containing particles of a second abrasive, said particles of said second abrasive being smaller than said particles of said first abrasive.

13. The system according to claim 12, wherein:

each of said first polishing apparatus (a) and said second polishing apparatus (c) is a planetary polishing apparatus comprising a porous polishing pad having a polishing surface treated to harden it and to minimize absorption of said particles of said first and second abrasives.

14. The system according to claim 13, wherein:

each of said first polishing apparatus (a) and said second polishing apparatus (c) comprises a porous polishing pad including a ceramic or amorphous glass material deposited on the polishing surface to harden it and to reduce the void area thereof without creating a hydrophobic condition.

15. The system according to claim 14, wherein:

each of said first polishing apparatus (a) and said second polishing apparatus (c) comprises a high density, formable polishing pad made of a polyurethane or woven material and said amorphous glass material deposited on said polishing surfaces is derived from at least one metal silicate.

16. The system according to claim 12, wherein:

each of said first polishing apparatus (a) and said second polishing apparatus (c) comprises means for recirculating the respective polishing slurry, each said recirculating means including filter means for removing particles of sizes equal to or greater than a pre-selected size from the respective polishing slurry.

17. The system according to claim 12, wherein:

said means for transferring said substrate from said first polishing apparatus to said second polishing apparatus comprises means for transferring said substrate in a wet state.

* * * * *